US009458863B2

(12) United States Patent
Bergamini et al.

(10) Patent No.: US 9,458,863 B2
(45) Date of Patent: Oct. 4, 2016

(54) TURBOMACHINE WITH MIXED-FLOW STAGE AND METHOD

(75) Inventors: Lorenzo Bergamini, Bari (IT); Vittorio Michelassi, Bayern (DE)

(73) Assignee: NUOVO PIGNONE S.P.A., Florence (IT)

( * ) Notice: Subject to any disclaimer, the term of this patent is extended or adjusted under 35 U.S.C. 154(b) by 781 days.

(21) Appl. No.: 13/220,119

(22) Filed: Aug. 29, 2011

(65) Prior Publication Data

US 2012/0057965 A1 Mar. 8, 2012

(30) Foreign Application Priority Data

Aug. 31, 2010 (IT) ..... CO2010A0047

(51) Int. Cl.
*F04D 31/00* (2006.01)
*F04D 7/04* (2006.01)
*F04D 3/00* (2006.01)
(Continued)

(52) U.S. Cl.
CPC ..... *F04D 31/00* (2013.01); *F04D 3/00* (2013.01); *F04D 7/04* (2013.01); *F04D 13/12* (2013.01); *F04D 29/181* (2013.01); *F04D 29/183* (2013.01); *F04D 29/22* (2013.01)

(58) Field of Classification Search
CPC ..... F04D 17/08; F04D 17/10; F04D 17/12; F04D 19/00; F04D 19/02; F04D 29/2211; F04D 31/00; F04D 13/12; F04D 29/22; F04D 3/00; F04D 29/181; F04D 29/183; F04D 1/06; F04D 7/04
USPC ..... 415/143, 162, 199.1, 199.2, 199.3, 415/199.4, 199.5, 199.6, 198.1; 416/175, 416/198 R, 198 A, 203, 201 R, 201 A
See application file for complete search history.

(56) References Cited

U.S. PATENT DOCUMENTS 4,224,010 A * 9/1980 Fujino ..... 415/199.2
5,375,976 A 12/1994 Arnaudeau
(Continued)

FOREIGN PATENT DOCUMENTS

EP 0795689 A1 9/1999
GB 704856 A 3/1954
(Continued)

OTHER PUBLICATIONS

Italian Search Report dated Apr. 4, 2011 for IT Patent Application No. ITC020100047.
(Continued)

*Primary Examiner* — Christopher Verdier
(74) *Attorney, Agent, or Firm* — GE Global Patent Operation; Marc A. Vivenzio

(57) ABSTRACT

In one embodiment, a turbomachine for imparting energy to a multiphase fluid is provided. The turbomachine comprises a casing having an inlet and an outlet; an axial stage part comprising at least one axial stage; a mixed-flow stage part comprising at least one mixed-flow stage fluidly connected to the axial stage part; and a centrifugal stage part comprising at least one centrifugal stage fluidly connected to the mixed-flow stage part. The axial stage is defined by an angle between an axial impeller outlet flow and an axis parallel to a rotational axis of the shaft having a value between 0° and 5°, the mixed-flow stage by an angle having a value between 5° and 80°, and the centrifugal stage by an angle having a value between 80° and 90°.

20 Claims, 8 Drawing Sheets

(51) Int. Cl.

| | |
|---|---|
| ***F04D 13/12*** | (2006.01) |
| ***F04D 29/18*** | (2006.01) |
| ***F04D 29/22*** | (2006.01) |

(56) References Cited

U.S. PATENT DOCUMENTS

| | | | | |
|---|---|---|---|---|
| 5,562,405 | A | 10/1996 | Ryall | |
| 5,755,554 | A | 5/1998 | Ryall | |
| 5,885,058 | A | 3/1999 | Vilagines | |
| 5,961,282 | A | 10/1999 | Wittrisch | |
| 6,210,126 | B1 * | 4/2001 | Charron | 417/244 |
| 6,273,672 | B1 | 8/2001 | Charron | |
| 6,312,216 | B1 | 11/2001 | Falcimaigne | |
| 6,382,919 | B1 | 5/2002 | Charron | |
| 6,547,513 | B1 | 4/2003 | Hummel et al. | |
| 6,547,514 | B2 | 4/2003 | Lee | |
| 7,150,600 | B1 * | 12/2006 | Vennat | 415/199.2 |
| 7,241,104 | B2 * | 7/2007 | Wilson et al. | 415/1 |
| 7,481,270 | B2 | 1/2009 | Shepler | |
| 2005/0186065 | A1 | 8/2005 | Wilson | |

FOREIGN PATENT DOCUMENTS

| | | | |
|---|---|---|---|
| RU | 2232301 | C1 | 7/2004 |
| RU | 70324 | U1 | 1/2008 |
| WO | 2007119010 | A1 | 10/2007 |
| WO | 2008107276 | A1 | 9/2008 |

OTHER PUBLICATIONS

Unofficial English Translation of Chinese Office Action and Search Report issued in connection with corresponding CN Application No. 201110268672.7 on Dec. 26, 2014.

Russian Notice of Acceptance issued in connection with corresponding RU Application No. 2011135905 on Jun. 10, 2015.

* cited by examiner

TURBOMACHINE WITH MIXED-FLOW STAGE AND METHOD

BACKGROUND OF THE INVENTION

1. Field of the Invention

Embodiments of the subject matter disclosed herein generally relate to methods and systems for pumping/compressing a multiphase fluid.

2. Description of the Prior Art

In recent years, with the increase in price of fossil fuels, the interest in developing new production fields has increased. Drilling onshore or offshore poses various problems. One such problem is that a petroleum fluid that comes out of a well comprises at least first and second components. The first component may be a gas and the second component may be a liquid. In addition, the gas component may not dissolve and/or mix into the liquid component. Thus, the petroleum fluid is a multiphase fluid.

Pumps and compressors are used in the industry for extracting the petroleum fluid from the well or for transporting it along a pipe. A pump is typically used for transporting a liquid while a compressor is used for transporting a gas. For these reasons, the pumps are designed to be efficient for liquids while the compressors are designed to be efficient for gases. Because of the different compositions of the gas and liquid and different laws of physics applying to these fluids, a pump is not efficient when a gas is present in the mixture and a compressor is not efficient when a liquid is present in the mixture.

Thus, for handling a multiphase fluid (e.g., a fluid that comprises at least a gas and a liquid component) it is customary to use various pumps connected in series. In this regard, U.S. Pat. No. 5,961,282 (the entire disclosure of which is incorporated by reference herein) discloses a system that comprises an axial-flow pump connected via a connecting part to a centrifugal pump.

An axial-flow pump, as the name suggests, imparts energy or pressure to a liquid that travels along an axial direction of the pump. For illustration, FIG. 1 shows an axial pump 10 having a casing 12 in which a statoric part 14 is configured to be provided about a shaft 16 and to deflect an incoming liquid. An impeller 18 is configured to rotate with shaft 16 and to direct the accelerated liquid. If shaft 16 is considered to extend along axis Z, then the liquid exiting the impeller 18 has substantially a speed v along axis Z. This property of the liquid exiting the impeller to move substantially along axis Z determines a pump to be axial-flow pump, i.e., the output liquid flows along the axis of the pump.

On the other end of the spectrum, a centrifugal pump makes the liquid exiting the impeller flow substantially radially from the axis of the pump, as shown in FIG. 2. FIG. 2 shows a centrifugal pump 20 in which a liquid is output with a speed v along axis X, radially from the axis of the pump that lies on Z. The liquid is shown entering along arrow A at an inlet 22.

Turning to U.S. Pat. No. 5,961,282, this reference discloses using a system 30 (see FIG. 3 which corresponds to FIG. 2B of U.S. Pat. No. 5,961,282) having an axial pump 32 and a centrifugal pump 34. A fluid enters inlet 36 and is acted upon by impeller provided after a statoric part 38. After passing the axial pump 32, as the fluid has a speed substantially parallel to a shaft 40, an adjuster 42, fixed to a casing 44, is used to deviate the incoming fluid to enter passage 46 (input) of the centrifugal pump 34 at a speed substantially perpendicular to the shaft 40. Blade 48 of the centrifugal pump 34 further imparts energy or pressure to the liquid and also changes the flow direction along a direction X perpendicular to the axis of the pump.

With the methods of the above noted reference and other references, a petroleum effluent is transported from, for example, the bottom of the well to the surface by using a pump system that comprises a set of front stages of helico-axial type, complemented with a set of back stages of the radial type (centrifugal stages). The two sets of stages may be stacked on the same axis.

Centrifugal stages are able to efficiently pump single-phase liquids only in the absence of a gas phase. As soon as the Gas-Volume-Fraction (GVF), which measures the ratio of gas to liquid phase volume rates, exceeds a few percent, conventional centrifugal stage performance deteriorates and prevents safe operation of the pump. To avoid this problem, the GVF is reduced by means of a set of axial stages, e.g., helicoaxial for the front stages, and radial stages for the last stages. The front set of helicoaxial stages are tolerant to high GVF, and they are able to gradually reduce the GVF through moderate pressure increase prior to reaching the last set of radial stages that are operated with a lower GVF. The first set of helicoaxial stages are capable of handling large GVF, but at the expense of a reduction in the pressure increase per stage. This solution requires an increase in the overall number of stages to reach the desired discharge pressure which increases weight, shaft length and cost.

Accordingly, it would be desirable to provide systems and methods that are better than the systems discussed above.

BRIEF SUMMARY OF THE INVENTION

According to one exemplary embodiment, there is a turbomachine for imparting energy to a multiphase fluid, the multiphase fluid comprising at least a liquid phase and a gaseous phase. The turbomachine comprises a casing having an inlet and an outlet; an axial stage part comprising at least one axial stage and configured to receive the multiphase fluid via the inlet and to compress the gaseous phase of the multiphase liquid; a mixed-flow stage part comprising at least one mixed-flow stage fluidly connected to the axial stage part; a centrifugal stage part comprising at least one centrifugal stage fluidly connected to the mixed-flow stage part and configured to output the multiphase fluid through the outlet; and a shaft connecting the axial stage part, the mixed-flow stage part and the centrifugal stage part. The axial stage is defined by an angle between an axial impeller outlet flow and an axis parallel to a rotational axis of the shaft having a value between 0° and 5°, the mixed-flow stage is defined by an angle between a mixed-flow impeller outlet flow and the axis parallel to the rotational axis of the shaft having a value between 5° and 80°, and the centrifugal stage is defined by an angle between a centrifugal impeller outlet flow and the axis parallel to the rotational axis of the shaft having a value between 80° and 90°.

According to one exemplary embodiment, there is a turbomachine for imparting energy to a multiphase fluid, the multiphase fluid comprising at least a liquid phase and a gaseous phase. The turbomachine comprises a casing having an inlet and an outlet; an axial stage part comprising at least one axial stage and configured to receive the multiphase fluid via the inlet and to compress the gaseous phase of the multiphase liquid; a mixed-flow stage part comprising at least one mixed-flow stage fluidly connected to the axial stage part and configured to output the multiphase fluid at the outlet; and a shaft connecting the axial stage part and the mixed-flow stage part. The axial stage is defined by an angle between an axial impeller outlet flow and an axis parallel to a rotational axis of the shaft having a value between 0° and 5°, and the mixed-flow stage is defined by an angle between a mixed-flow impeller outlet flow and the axis parallel to the rotational axis of the shaft having a value between 5° and 80°.

According to one exemplary embodiment, there is a turbomachine for imparting energy to a multiphase fluid, the multiphase fluid comprising at least a liquid phase and a gaseous phase. The turbomachine comprises a casing having an inlet and an outlet; a mixed-flow stage part comprising at least one mixed-flow stage fluidly connected to the inlet; a centrifugal stage part comprising at least one centrifugal stage fluidly connected to the mixed-flow stage part and configured to output the multiphase fluid through the outlet; and a shaft connecting the mixed-flow stage part and the centrifugal stage part. The mixed-flow stage is defined by an angle between a mixed-flow impeller outlet flow and an axis parallel to a rotational axis of the shaft having a value between 5° and 80°, and the centrifugal stage is defined by an angle between a centrifugal impeller outlet flow and the axis parallel to the rotational axis of the shaft having a value between 80° and 90°.

According to one exemplary embodiment, there is a method for imparting energy to a multiphase fluid, the multiphase fluid comprises at least a liquid phase and a gaseous phase. The method comprises a step of fluidly connecting an axial stage part to a mixed-flow stage part and to a centrifugal stage part in this order; a step of providing the axial stage part, the mixed-flow stage part and the centrifugal stage part into a casing having an inlet and an outlet; and a step of connecting an axial impeller of the axial stage part, a mixed-flow impeller of the mixed-flow stage part, and a centrifugal impeller of the centrifugal stage part to a shaft. The axial stage part is defined by an angle between the axial impeller outlet flow and an axis parallel to a rotational axis of the shaft having a value between 0° and 5°, the mixed-flow stage part is defined by an angle between the mixed-flow impeller outlet flow and the axis parallel to the rotational axis of the shaft having a value between 5° and 80°, and the centrifugal stage is defined by an angle between the centrifugal impeller outlet flow and the axis parallel to the rotational axis of the shaft having a value between 80° and 90°.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of axial and centrifugal pumps. However, the embodiments to be discussed next are not limited to these pumps, but may be applied to other systems, e.g., compressors or other turbomachines.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a turbomachine comprises a set of impellers of different types suitable to start the compression of a fluid with a high volumetric percentage of gas and to reach a discharge pressure with a minimum number of stages. The structure of the turbomachine comprises at least two of axial, mixed-flow and radial stages. This structure allows a wide operability under variable gaseous content in a matrix of a liquid fluid.

The novel turbomachine is capable of increasing the pressure of liquids in the presence of gases not dissolved in the liquids. Operating conditions include a liquid saturated with a gas. The turbomachine addresses the needs of, for example, pumping from oil wells where the process fluid comprises one or more gaseous phases embedded into one or more liquid phases, and possible solid particles.

For the purpose of this disclosure a "stage" is defined as a system (machine) or part of a machine, having an impeller (moving part) of any type (e.g., axial, radial or mixed-flow), and a diffuser (static part) of any type (vaned or scroll-type, axial or radial or mixed-flow).

Figure 2:
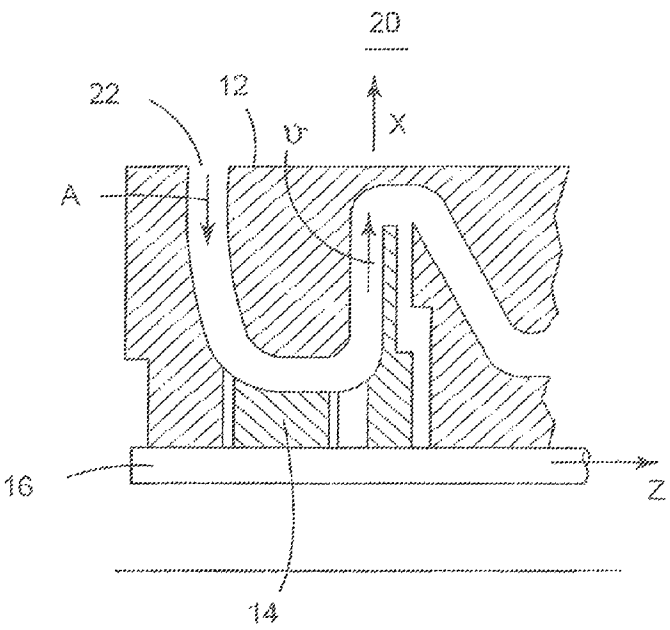
Figure 2 (PRIOR ART)
FIG. 2 is a schematic diagram of a conventional centrifugal pump.
Figure 1:
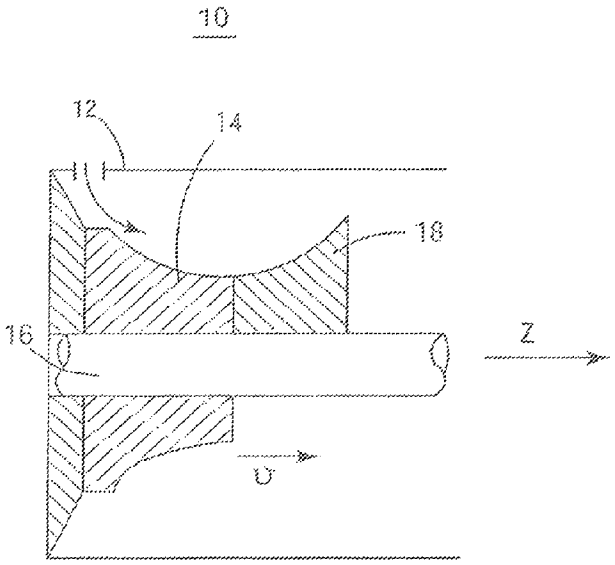
Figure 1 (PRIOR ART)
FIG. 1 is a schematic diagram of a conventional axial pump.
Figure 3:
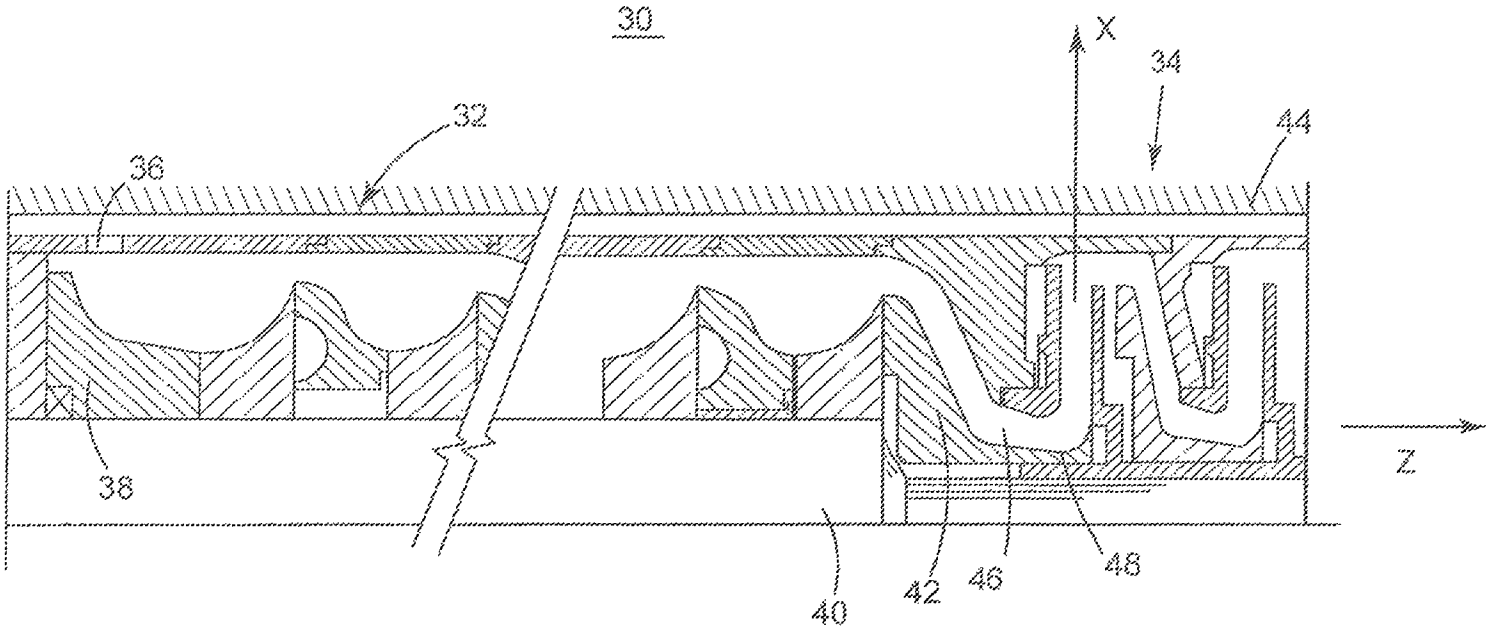
Figure 3 (PRIOR ART)
FIG. 3 is a schematic diagram of a system comprising an axial pump followed by a centrifugal pump.
Figure 4:
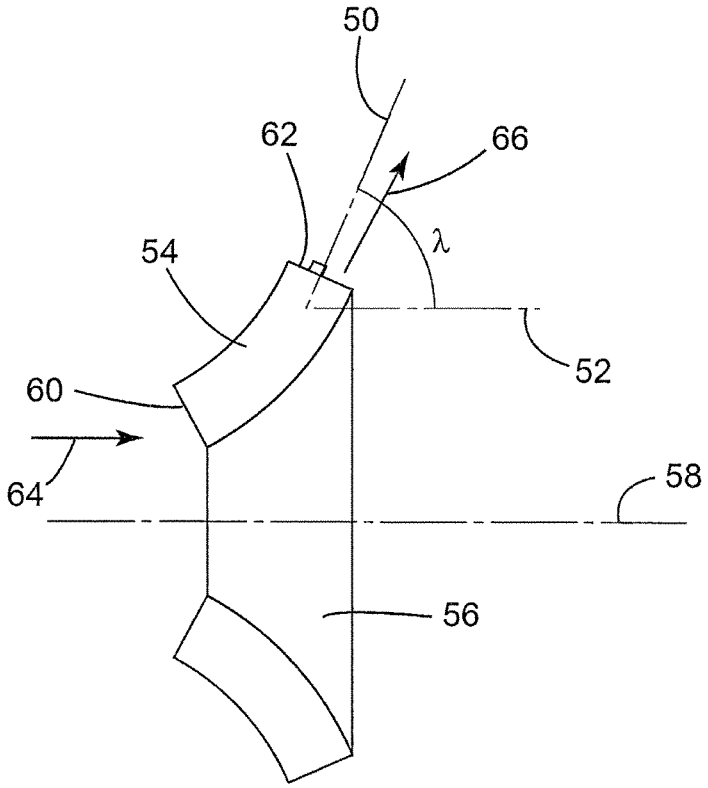
FIG. 4 is a schematic diagram of an angle between a gas flow from an impeller and a rotational axis of the impeller.

According to an exemplary embodiment, a reduced number of stages for achieving a given discharge pressure is achieved by introducing a gradual transition between helicoaxial and radial type stages. The gradual transition may include moving parts, e.g., an impeller. A helicoaxial stage may be an axial pump stage and a radial stage may be a centrifugal pump stage. An angle lambda that defines the axial type versus the centrifugal type is shown in FIG. 4 as an angle between an average impeller outlet flow 50 and an axis 52 parallel to a rotational axis 58 in a plane comprising the axis 52. FIG. 4 shows a blade 54 of an impeller 56 having the rotational axis 58. Blade 54 has a leading edge 60 and a trailing edge 62. The fluid to be moved by the blade 54 first contacts the leading edge 60 when moving along direction 64 and exits the trailing edge 62 of the blade along direction 66 which is parallel with flow 50. In one application, the direction of the flow 50 is perpendicular to the trailing edge 62.

An axial stage has the values of λ in the range of 0° to 5° while a centrifugal stage has the values of λ in the range of 80° to 90°. A mixed-flow stage (pump or compressor) has the λ in the range of 5° to 80°.

Figure 5:
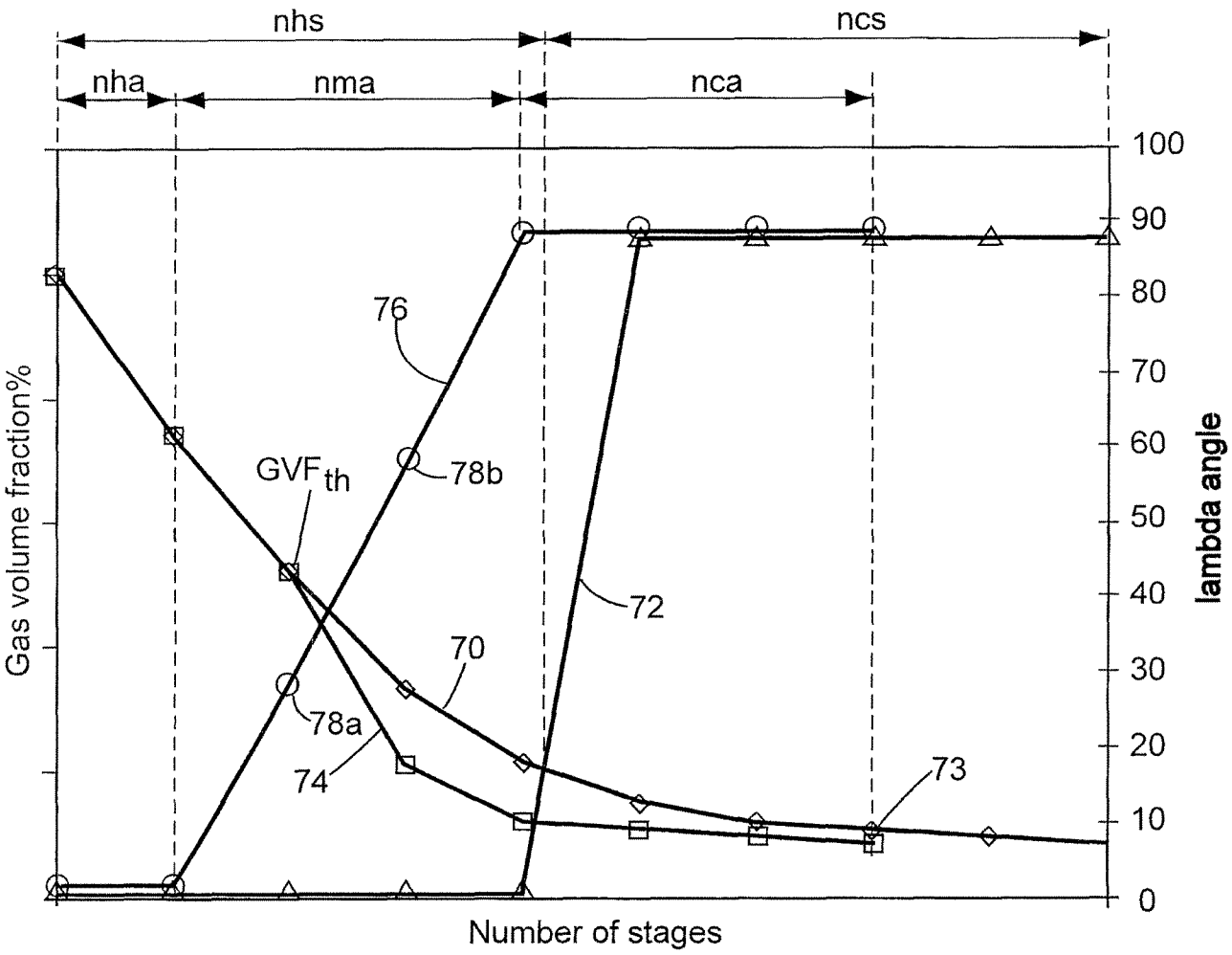
FIG. 5 is a graph illustrating the change in a gas volume fraction versus a number of stages for a turbomachine comprising various types of stages.

While axial stages in a multistage machine (comprising both axial and centrifugal stages) reduce the GVF in the fluid, thus allowing the centrifugal stages to more efficiently compress the fluid, the number of stages for such a machine is larger than the optimal minimum. FIG. 5 illustrates the number of stages correlated with the GVF and λ for such a machine. This machine (that has more stages than necessary) has nhs (number of helioaxial stages in prior art) axial stages followed by ncs (number of centrifugal stages in prior art) centrifugal stages with the axial stages having λ smaller than 5° and the centrifugal stages having λ larger than 80° and smaller than 90°. The number of stages depends on the size of the pumps (stages) and the composition of the fluid.

FIG. 5 shows a curve 70 that correlates the GVF percentage (first Y axis) with each stage (represented on the X axis) and a curve 72 that correlates the value of λ (second Y axis) with each stage for a machine having only axial and radial stages. It is noted that curve 72 shows a value of zero for λ for the first nhs stages (axial pumps) and a value of 90° for λ for the next ncs stages (centrifugal pumps).

Figure 6:
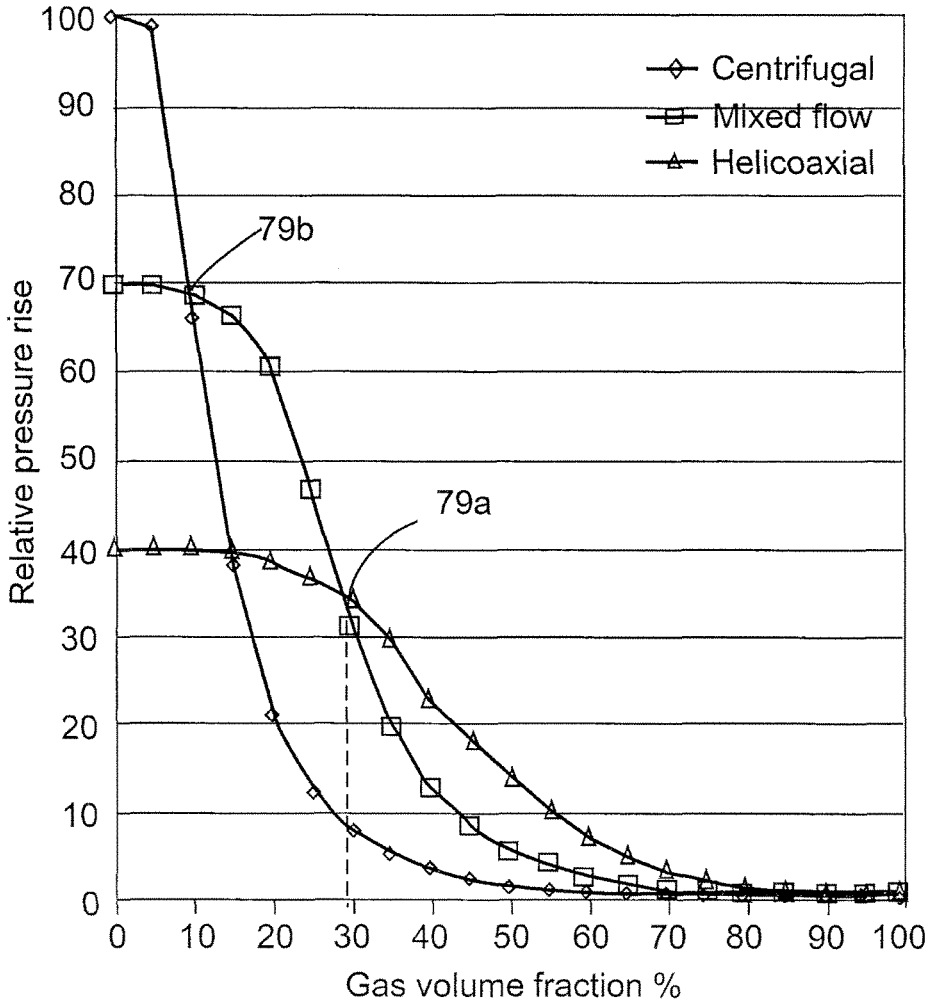
FIG. 6 is a graph illustrating a pressure rise achieved by various stages as a function of a GVF of the fluid flowing through the turbomachine according to an exemplary embodiment.

However, this situation changes for a novel turbomachine having nha axial stages (number of helioaxial stages), nma (number of mixed flow stages) mixed-flow stages and nca centrifugal stages. FIG. 5 shows that this machine achieves the same GVF 73 with a lower number of stages (nha+nma+nca) instead of (nhs+ncs) stages as for the previous machine. This is because the nma mixed-flow stages further decrease the GVF value from curve 70 to curve 74, thus allowing the λ to transition in a less steep manner (see curve 76) from a low value (e.g., 0°) to a high value (e.g., 90°), i.e., from an axial phase to a centrifugal phase. A less steep transition may be defined, for example, as having at least one intermediate value between 0° and 90° , e.g., the lambda angle function has two values between zero and ninety as shown by points 78*a* and 78*b* in FIG. 5. This transition due to the mixed-flow stages allows the GVF to quickly decrease as the mixed-flow stages are more effective than the helicoaxial stages below a given GVF threshold $GVF_{th}$, also shown in FIG. 5. An example of the threshold $GVF_{th}$ is shown in FIG. 6. This figure shows the relative pressure rise across a stage versus the GVF for the centrifugal, mixed-flow and helicoaxial stages. It is noted that the mixed flow stage becomes more efficient than the helicoaxial stage at around 20 to 40%, which corresponds to the $GVF_{th}$ 79*a*. In other words, the novel turbomachine is designed to use one or more mixed-flow stages when the GVF is in this range, as being more efficient than the traditional helicoaxial stages. A transition from the mixed-flow stages to the centrifugal stages may take place when the GVF is in the range of 10 to 20%, e.g., at point 79*b* when the centrifugal stage is more efficient than the mixed-flow stage. The numbers and thresholds shown in FIG. 6 are illustrative and depend on the size of the machine, the number of stages, the composition of the fluid, etc. Thus, for one turbomachine, the values shown in FIG. 6 are accurate while for other turbomachines these values have to be adjusted.

Figure 7:
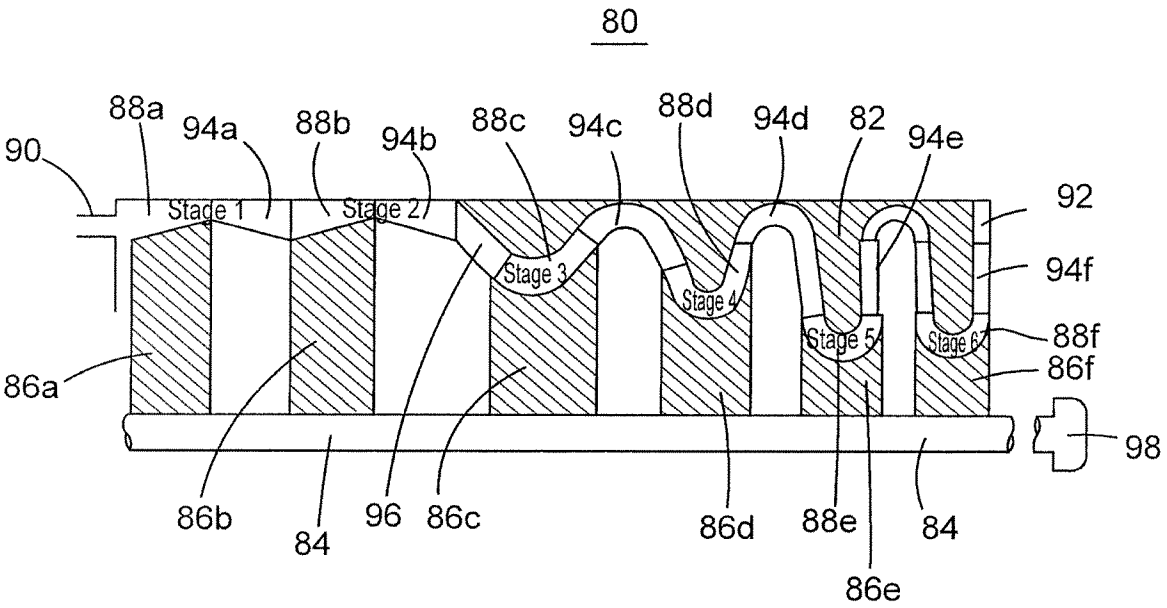
FIG. 7 is a schematic diagram of a turbomachine having various types of stages.

The mixed-flow stages nma are characterized by angle λ having a value larger than 5° and smaller than 80°. Such a turbomachine 80 is schematically illustrated in FIG. 7. According to this exemplary embodiment, the turbomachine 80 has a casing 82 and a shaft 84. Shaft 84 may be a single shaft or multiple shafts connected to each other. Various impellers 86*a* to 86*f* are connected to the shaft 84 and are configured to rotate with the shaft. Each impeller has at least a corresponding blade 88*a* to 88*f* that imparts energy and/or pressure to the fluid passing by. The fluid enters the turbomachine 80 at an inlet 90 and exits the machine at an outlet 92. While the machine shown in FIG. 7 has 6 stages, it should not be inferred that this is the minimum, maximum or optimum number of stages for such a machine. The six stages are for illustration only. In addition, it should not be inferred that all three types of stages should be present in such a machine. It is envisioned to have a turbomachine only with axial and mixed-flow stages, only mixed-flow and centrifugal stages or with all three stages.

In this exemplary embodiment, the first two stages are axial stages, as recognized by the λ of the trailing edge of the blades of the impellers, the next two stages are mixed-flow stages and the last two stages are centrifugal stages. Again, the number of stages is exemplary and it should not be inferred that the combination shown in FIG. 7 is the optimal configuration. For example, it is possible to have one axial stage, one mixed-flow stage and one centrifugal stage.

Each blade 88*a* to 88*f* in FIG. 7 has a corresponding diffuser 94*a* to 94*f*. These diffusers are static, i.e., fixed to the casing or another non-movable part of the turbomachine. The diffusers are configured to change the fluid flow to optimize the efficiency of each stage. Also seen in FIG. 7 is a flow adjustment part 96 or a transitional channel, also fixed to the casing and configured to make a transition of the fluid flow between the axial stage and the mixed-flow stage.

Shaft 84 of the turbomachine may be connected to a driver 98, which may be an electrical motor, an engine, a gas turbine, etc. In one application, all the stages are placed in a single casing 82 such that the turbomachine is a single piece of equipment. The turbomachine may have a cylindrical shape to be able to enter a well for petroleum effluent extraction.

In this exemplary embodiment, blades 88*c* and 88*d* of the mixed-flow stages 3 and 4 have angle λ having values in the range of about 30° to 44° and 50° to 65° respectively. In one application, the angle of the mixed-flow stage has a value between 20° and 60°. As discussed above, the stages of the turbomachine may be implemented as pumps only, as compressors only, or as a combination of pumps and compressors.

Figure 8:
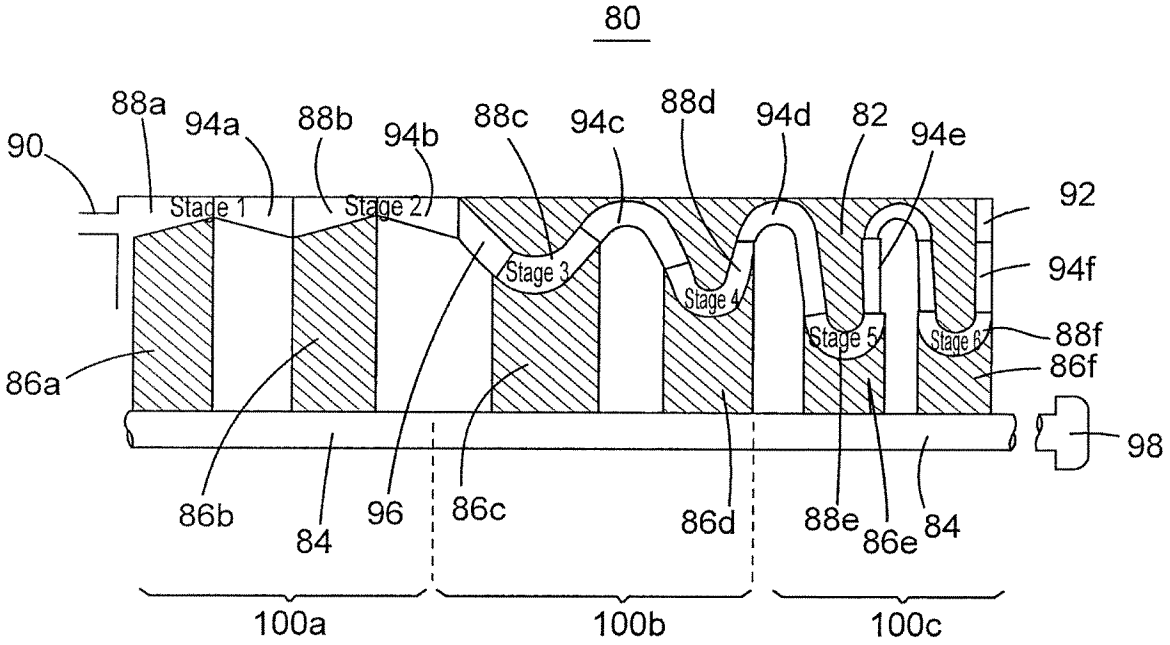
FIG. 8 is another schematic diagram of a turbomachine having various types of stages.

According to an exemplary embodiment illustrated in FIG. 8, a turbomachine 80 for imparting energy to a multiphase fluid comprises a casing 82 having an inlet 90 and an outlet 92, an axial stage part 100*a* comprising at least one axial stage (Stage 1) and configured to receive the multiphase fluid via the inlet 90 and to compress the gaseous phase of the multiphase liquid, a mixed-flow stage part (100*b*) comprising at least one mixed-flow stage (Stage 3) fluidly connected to the axial stage part, a centrifugal stage part 100*c* comprising at least one centrifugal stage (Stage 5) connected to the mixed-flow stage part and configured to output the multiphase fluid through the outlet 92, and a shaft 84 connecting the axial stage part 100*a*, the mixed-flow stage part 100*b* and the centrifugal stage part 100*c*. The axial stage is defined by an angle between an axial impeller outlet flow and an axis parallel to a rotational axis of the shaft having a value between 0° and 5°, the mixed-flow stage is defined by an angle between a mixed-flow impeller outlet flow and the axis parallel to the rotational axis of the shaft having a value between 5° and 80°, and the centrifugal stage is defined by an angle between a centrifugal impeller outlet flow and the axis parallel to the rotational axis of the shaft having a value between 80° and 90°.

Figure 9:
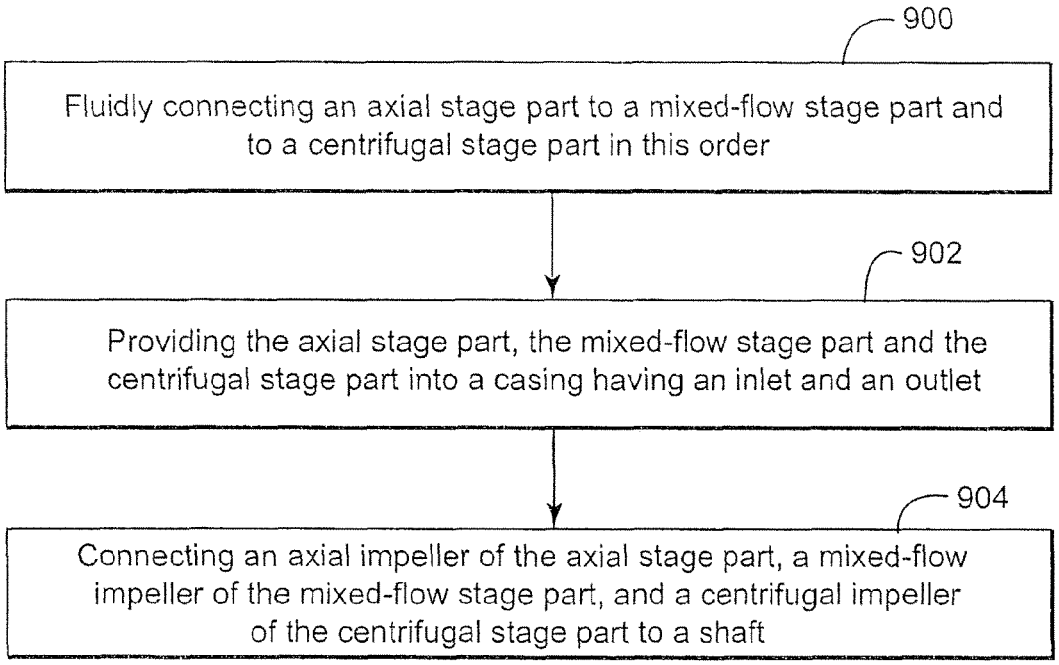
FIG. 9 is a flow chart illustrating a method for imparting energy to a multiphase fluid according to an exemplary embodiment.

According to an exemplary embodiment illustrated in FIG. 9, there is a method for imparting energy to a multiphase fluid, the multiphase fluid comprising at least a liquid phase and a gaseous phase. The method comprises a step 900 of fluidly connecting an axial stage part to a mixed-flow stage part and to a centrifugal stage part in this order; a step 902 of providing the axial stage part, the mixed-flow stage part and the centrifugal stage part into a casing having an inlet and an outlet; and a step 904 of connecting an axial impeller of the axial stage part, a mixed-flow impeller of the mixed-flow stage part, and a centrifugal impeller of the centrifugal stage part to a shaft. The axial stage part is defined by an angle between the axial impeller outlet flow and an axis parallel to a rotational axis of the shaft having a value between 0° and 5°, the mixed-flow stage part is defined by an angle between the mixed-flow impeller outlet flow and the axis parallel to the rotational axis of the shaft having a value between 5° and 80°, and the centrifugal stage is defined by an angle between the centrifugal impeller outlet flow and the axis parallel to the rotational axis of the shaft having a value between 80° and 90°.

The disclosed exemplary embodiments provide a system and a method for imparting energy to a multiphase fluid comprising at least a liquid phase and a gas phase. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, comprising making and using any devices or systems and performing any incorporated methods. The patentable scope of the subject matter is defined by the claims, and may include other examples that occur to those skilled in the art. Such other examples are intended to be within the scope of the claims.

What is claimed is:

1. A turbomachine for imparting energy to a multiphase fluid, the multiphase fluid comprising at least a liquid phase and a gaseous phase, the turbomachine comprising:

a casing having an inlet and an outlet;

an axial stage part comprising at least one axial stage;

a mixed-flow stage part comprising at least one mixed-flow stages fluidly connected to the axial stage part;

a centrifugal stage part comprising at least one centrifugal stage fluidly connected to the mixed-flow stage part;

a shaft connecting the axial stage part, the mixed-flow stage part, and the centrifugal stage part;

wherein the at least one axial stage is defined by an angle between an axial impeller outlet flow and an axis parallel to a rotational axis of the shaft having a value between 0° and 5°;

the at least one mixed-flow stage is defined by an angle between a mixed-flow impeller outlet flow and the axis parallel to the rotational axis of the shaft having a value between 5° and 80°; and the at least one centrifugal stage is defined by an angle between a centrifugal impeller outlet flow and the axis parallel to the rotational axis of the shaft having a value between 80° and 90°;

wherein the angles of the axial, the mixed-flow, and the centrifugal stage part are configured to correlate with Gas-Volume-Fraction (GVF) values of the multiphase fluid, and wherein GVF is a ratio of gaseous phase to liquid phase volume rates of the multiphase fluid.

2. The turbomachine of claim 1, wherein the axial stage part comprises at least two axial stages, and the centrifugal stage part comprises at least two centrifugal stages.

3. The turbomachine of claim 2, wherein each stage comprises a rotor having impellers that are configured to rotate with the shaft and a diffuser fixed to the casing and configured to change a direction of a corresponding flow.

4. The turbomachine of claim 1, wherein the inlet is axial and the outlet is radial.

5. The turbomachine of claim 1, further comprising:

an adjusting part between the axial stage part and the mixed-flow stage part.

6. The turbomachine of claim 1, wherein a transition from the axial stage part to the mixed-flow stage part takes place when a Gas-Volume-Fraction (GVF) value of the multiphase fluid reaches a threshold value, wherein the threshold value is determined based on a correlation between the CAT value and a relative pressure rise across the axial and the mixed-flow stage part.

7. The turbomachine of claim 1, wherein the angle of the mixed-flow stage has a value between 20° and 60°.

8. A method for imparting energy to a multiphase fluid, the multiphase fluid comprising at least a liquid phase and a gaseous phase, the method comprising:

fluidly connecting an axial stage part to a mixed-flow stage part and to a centrifugal stage part in this order, the mixed flow stage part comprising a plurality of mixed flow stages;

providing the axial stage part, the mixed-flow stage part and the centrifugal stage part into a casing having an inlet and an outlet; and connecting an axial impeller of the axial stage part, a mixed-flow impeller of the mixed-flow stage part, and a centrifugal impeller of the centrifugal stage part to a shaft, wherein the axial stage part is defined by an angle between an axial impeller outlet flow and an axis parallel to a rotational axis of the shaft having a value between 0° and 5°, the mixed-flow stage part is defined by an angle between a mixed-flow impeller outlet flow and the axis parallel to the rotational axis of the shaft having a value between 5° and 80°, and the centrifugal stage part is defined by an angle between a centrifugal impeller outlet flow and the axis parallel to the rotational axis of the shaft having a value between 80° and 90°;

wherein the angles of the axial, the mixed-flow, and the centrifugal stage part are configured to correlate with Gas-Volume-Fraction (GVF) values of the multiphase fluid, and wherein GVF is a ratio of gaseous phase to liquid phase volume rates of the multiphase fluid.

9. The method of claim 8, wherein the axial stage part comprises at least two axial stages, and the centrifugal stage part comprises at least two centrifugal stages.

10. The method of claim 9, wherein each stage comprises a rotor having impellers that are configured to rotate with the shaft and a diffuser fixed to the casing and configured to change a direction of a corresponding flow.

11. The method of claim 8, wherein the inlet is axial and the outlet is radial.

12. The method of claim 8, further comprising:

adjusting the axial stage part and the mixed-flow stage part.

13. The method of claim 8, wherein a transition from the axial stage part to the mixed-flow stage part takes place when a Gas-Volume-Fraction (GVF) value of the multiphase fluid reaches a threshold value, wherein the threshold value is determined based on a correlation between the CAT value and a relative pressure rise across the axial and the mixed-flow stage part.

14. The method of claim 8, wherein the angle of the mixed-flow stage has a. value between 20° and 60°.

15. A turbomachine for imparting energy to a multiphase fluid, the multiphase fluid comprising at least a liquid phase and a gaseous phase, the turbomachine comprising:

a casing having an inlet and an outlet;

an axial stage part comprising at least one axial stage and configured to receive the multiphase fluid via the inlet;

a mixed-flow stage part fluidly connected to the axial stage part, the mixed-flow stage part comprising at least one mixed-flow stage;

a shaft connecting the axial stage part and the mixed-flow stage part;

wherein the at least one axial stage is defined by an angle between an axial impeller outlet flow and an axis parallel to a rotational axis of the shaft having a value between 0° and 5°; and the at least one mixed-flow stage is defined by an angle between a mixed-flow impeller outlet flow and the axis parallel to the rotational axis of the shaft having a value between 5° and 80°;

wherein the angles of the axial and the mixed-flow stage part are configured to correlate with Gas-Volume-Fraction (GVF) values of the multiphase fluid, and wherein GVF is a ratio of gaseous phase to liquid phase volume rates of the multiphase fluid.

16. The turbomachine of claim 15, wherein the axial stage part comprises at least two axial stages.

17. The turbomachine of claim 16, wherein each stage comprises a rotor having impellers that are configured to rotate with the shaft and a diffuser fixed to the casing and configured to change a direction of a corresponding flow.

18. The turbomachine of claim 15, wherein the inlet is axial and the outlet is radial.

19. The turbomachine of claim 15, wherein the axial stage part comprises at least two axial stages, and the centrifugal stage part comprises at least two centrifugal stages.

20. A turbomachine for imparting energy to a multiphase fluid, the multiphase fluid comprising at least a liquid phase and a gaseous phase, the turbomachine comprising:

a casing having an inlet and an outlet;

a mixed-flow stage part, the mixed-flow stage part comprising at least one mixed-flow stage;

a centrifugal stage part comprising at least one centrifugal stage fluidly connected to the mixed-flow stage part;

a shaft connecting, the mixed-flow stage part and the centrifugal stage part;

wherein the at least one mixed-flow stage is defined by an angle between a mixed-flow impeller outlet flow and the axis parallel to the rotational axis of the shaft having a value between 5° and 80°; and the at least one centrifugal stage is defined by an angle between a centrifugal impeller outlet flow and the axis parallel to the rotational axis of the shaft having a value between 80° and 90°, wherein the angles of the mixed-flow and the centrifugal stage parts are configured to correlate with Gas-Volume-Fraction (GVF) values of the multiphase fluid, and wherein GVF is a ratio of gaseous phase to liquid phase volume rates of the multiphase fluid.

* * * * *